US009194167B2

(12) United States Patent
Gassion

(10) Patent No.: US 9,194,167 B2
(45) Date of Patent: Nov. 24, 2015

(54) METHOD FOR THE INDIVIDUALIZED AND AUTOMATED CONTROL OF THE MEANS FOR CLOSING OFF AT LEAST ONE WINDOW, CONTROL ASSEMBLY FOR IMPLEMENTING SAID METHOD, AND PARAMETER-SETTING TOOL FOR SAID ASSEMBLY

(75) Inventor: Romain Gassion, Izeaux (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 13/994,350

(22) PCT Filed: Nov. 24, 2011

(86) PCT No.: PCT/FR2011/000620

§ 371 (c)(1),
(2), (4) Date: Jun. 14, 2013

(87) PCT Pub. No.: WO2012/080589

PCT Pub. Date: Jun. 21, 2012

(65) Prior Publication Data

US 2013/0263510 A1 Oct. 10, 2013

(30) Foreign Application Priority Data

Dec. 16, 2010 (FR) ..... 10/04913

(51) Int. Cl.

| | |
|---|---|
| ***E05F 15/20*** | (2006.01) |
| ***E06B 9/26*** | (2006.01) |
| ***E06B 9/32*** | (2006.01) |

(Continued)

(52) U.S. Cl.

CPC ..... *E05F 15/20* (2013.01); *E05F 15/2007* (2013.01); *E05F 15/2076* (2013.01); *E05F 15/70* (2015.01); *E05F 15/71* (2015.01); *E05F 15/77* (2015.01); *E06B 9/26* (2013.01); *E06B 9/32* (2013.01); *E05Y 2900/00* (2013.01); *E05Y 2900/106* (2013.01); *E06B 2009/2417* (2013.01); *E06B 2009/6827* (2013.01)

(58) Field of Classification Search

USPC ..... 49/29, 30, 31; 160/5; 318/445, 466, 318/468, 480; 700/275–278

See application file for complete search history.

(56) References Cited

U.S. PATENT DOCUMENTS 4,538,218 A * 8/1985 Watson ..... 362/295
5,134,347 A * 7/1992 Koleda ..... 318/16

(Continued)

FOREIGN PATENT DOCUMENTS

FR 2 922 938 6/2012
WO WO 2007/030322 A2 3/2007

*Primary Examiner* — Katherine Mitchell
*Assistant Examiner* — Justin Rephann
(74) *Attorney, Agent, or Firm* — Steptoe & Johnson LLP

(57) ABSTRACT

A method for individualized control of means for closing off at least one window, by: determining coordinates of a dazzle cone associated with a window and with a dazzle-sensitive zone, the dazzle cone defined by a vertex positioned at the dazzle-sensitive zone and a directrix curve superimposed on the perimeter of the window; determining the orientation of direct rays of sunlight, and defined by a solar azimuth and a solar elevation; periodically checking whether the orientation falls within a predetermined dazzle cone; the directions of the rays of sunlight being parallel to one of the directions within the dazzle cone and passing through the vertex of the cone; and acting on closing-off means associated with the window for which orientation of rays of sunlight falls within a dazzle cone.

9 Claims, 5 Drawing Sheets

(51) Int. Cl.

| | |
|---|---|
| ***E05F 15/70*** | (2015.01) |
| ***E05F 15/71*** | (2015.01) |
| ***E05F 15/77*** | (2015.01) |
| *E06B 9/24* | (2006.01) |
| *E06B 9/68* | (2006.01) |

(56) References Cited

U.S. PATENT DOCUMENTS

| | | | | |
|---|---|---|---|---|
| 5,237,169 | A * | 8/1993 | Grehant | 250/214 AL |
| 5,598,000 | A * | 1/1997 | Popat | 250/206 |
| 5,663,621 | A * | 9/1997 | Popat | 318/480 |
| 5,701,058 | A * | 12/1997 | Roth | 315/158 |
| 6,084,231 | A * | 7/2000 | Popat | 250/214 AL |
| 6,181,089 | B1 * | 1/2001 | Kovach et al. | 318/16 |
| 6,259,218 | B1 * | 7/2001 | Kovach et al. | 318/16 |
| 6,583,573 | B2 | 6/2003 | Bierman | |
| 6,781,335 | B2 * | 8/2004 | Osinga et al. | 318/445 |
| 6,812,662 | B1 * | 11/2004 | Walker | 318/280 |
| 7,085,627 | B2 * | 8/2006 | Bamberger et al. | 700/277 |
| 7,566,137 | B2 | 7/2009 | Veskovic | |
| 7,588,067 | B2 * | 9/2009 | Veskovic | 160/5 |
| 7,977,904 | B2 * | 7/2011 | Berman et al. | 318/480 |
| 8,102,586 | B2 * | 1/2012 | Albahri | 359/265 |
| 8,125,172 | B2 * | 2/2012 | Berman et al. | 318/480 |
| 8,228,184 | B2 * | 7/2012 | Blakeley et al. | 340/539.1 |
| 8,248,014 | B2 * | 8/2012 | Berman et al. | 318/466 |
| 8,288,981 | B2 * | 10/2012 | Zaharchuk et al. | 318/468 |
| 8,417,388 | B2 * | 4/2013 | Altonen et al. | 700/278 |
| 8,432,117 | B2 * | 4/2013 | Berman et al. | 318/445 |
| 8,451,116 | B2 * | 5/2013 | Steiner et al. | 340/545.3 |
| 8,508,169 | B2 * | 8/2013 | Zaharchuk et al. | 318/468 |
| 8,525,462 | B2 * | 9/2013 | Berman et al. | 318/480 |
| 8,587,242 | B2 * | 11/2013 | Berman et al. | 318/466 |
| 8,639,387 | B2 * | 1/2014 | Byberg et al. | 700/278 |
| 8,723,466 | B2 * | 5/2014 | Chambers et al. | 318/445 |
| 8,723,467 | B2 * | 5/2014 | Berman et al. | 318/466 |
| 2003/0090210 | A1 | 5/2003 | Bierman | |
| 2005/0001574 | A1 * | 1/2005 | Bejean | 318/468 |
| 2005/0110416 | A1 * | 5/2005 | Veskovic | 315/149 |
| 2006/0207730 | A1 * | 9/2006 | Berman et al. | 160/310 |
| 2007/0189000 | A1 * | 8/2007 | Papamichael et al. | 362/1 |
| 2009/0149973 | A1 * | 6/2009 | Keller et al. | 700/90 |
| 2009/0254222 | A1 * | 10/2009 | Berman et al. | 700/275 |
| 2010/0071856 | A1 | 3/2010 | Zaharchuk et al. | |
| 2010/0157427 | A1 * | 6/2010 | Berman et al. | 359/597 |
| 2010/0164398 | A1 * | 7/2010 | Verburgh | 315/292 |
| 2010/0262292 | A1 | 10/2010 | Grehant et al. | |
| 2010/0332034 | A1 * | 12/2010 | Bergeson et al. | 700/275 |
| 2011/0209408 | A1 * | 9/2011 | Scharf et al. | 49/31 |
| 2011/0213500 | A1 * | 9/2011 | Scharf et al. | 700/276 |
| 2011/0240232 | A1 * | 10/2011 | Kluck | 160/5 |
| 2012/0150485 | A1 * | 6/2012 | Wang | 702/150 |
| 2012/0261079 | A1 * | 10/2012 | Chambers et al. | 160/6 |
| 2012/0320560 | A1 * | 12/2012 | Van Der Poel et al. | 362/1 |
| 2013/0063065 | A1 * | 3/2013 | Berman et al. | 318/480 |
| 2013/0226351 | A1 * | 8/2013 | Altonen et al. | 700/275 |
| 2013/0306246 | A1 * | 11/2013 | Zaharchuk et al. | 160/5 |

* cited by examiner

METHOD FOR THE INDIVIDUALIZED AND AUTOMATED CONTROL OF THE MEANS FOR CLOSING OFF AT LEAST ONE WINDOW, CONTROL ASSEMBLY FOR IMPLEMENTING SAID METHOD, AND PARAMETER-SETTING TOOL FOR SAID ASSEMBLY

This application is a national stage entry of International Application No. PCT/FR2011/000620, filed Nov. 24, 2011, designating the U.S., and which claims the benefit of French Application No. 10-04913, filed Dec. 16, 2010.

TECHNICAL FIELD OF THE INVENTION

The invention relates to a method for the individualized and automated control of the means for closing off at least one window of a building.

The invention also relates to an assembly for the individualized and automated control of the means for closing off at least one window of a building for implementing the control method.

The invention also relates to a tool for setting the parameters of at least one dazzle cone for implementing the control method.

PRIOR ART

It is known practice to control the opening and/or closing of means that close off a window of a building. The opening and/or closing of the closing-off means, such as slatted blinds for example, is performed according to various criteria.

As described in Patent Application FR 2 922 938, the orientation of the slats of the blinds is set according to the orientation of the direct rays of sunlight. The orientation of the rays is defined essentially by the elevation. Other parameters such as the brightness of the sky may be taken into consideration for controlling the opening and/or closing of the closing-off means. This solution also incorporates a graph incorporating all of the solar projections stored in memory over the course of one year.

This type of solution may have the disadvantage of not taking into consideration the level of lighting present in the room or rooms.

To address this disadvantage, the solution described in U.S. Pat. No. 7,566,137, U.S. Pat. No. 6,583,573 incorporates light sensors inside the building. The sensors are positioned preferably in spaces that have a window with closing-off means.

In general, the existing solutions, which vary in their complexity in terms of the integration of control parameters, do not take into consideration the orientation of all the directions of the solar radiation with respect to a sensitive spatial zone within the building.

SUMMARY OF THE INVENTION

The invention therefore seeks to address the disadvantages of the prior art in such a way as to propose a method of regulating The control method according to the invention consists in:

- determining coordinates of at least one dazzle cone associated with a window and with a dazzle-sensitive zone situated inside the building, said at least one dazzle cone being defined by, on the one hand, a vertex positioned at the sensitive zone and a directrix curve superimposed on the perimeter of said at least one window;

- determining the orientation of the direct rays of sunlight, the orientation of said rays being defined by a solar azimuth and a solar elevation;
- periodically checking whether the orientation of the rays of sunlight falls within at least one predetermined dazzle cone; the direction of the rays of sunlight being parallel to one of the directions contained within the dazzle cone and passing through the vertex of said cone;
- acting on the closing-off means associated with said at least one window for which the orientation of the rays of sunlight falls within at least one dazzle cone.

According to one particular embodiment, the control method consists in:

- determining the light intensity outside in an environment close to said at least one window that is to be closed off,
- comparing the measured light intensity against a closing-off threshold, and
- acting on the closing-off means if the closing-off threshold is crossed.

Advantageously, the method consists in acting on the closing-off means of at least one window adjacent to said at least one window for which the orientation of the rays of sunlight falls within at least one dazzle cone.

According to one embodiment of the invention, the method consists in voltage control of the closing-off means comprising a glass of electrochromic type positioned in the window recess.

For preference, the closing-off means act gradually on the glass of electrochromic type so as to darken said glass between a minimum threshold that allows a maximum amount of light through and a maximum threshold that allows a minimum amount of light through.

For preference, the method consists in measuring the light intensities outside and inside and acting on the closing-off means in such a way that the light intensity on the inside is constant.

For preference, the method consists in converting all of the coordinates to one and the same spatial frame of reference so that the coordinates of the directions of the cone, of the solar azimuth and of the solar elevation can be expressed in an absolute or relative frame of reference.

According to one particular embodiment, the directrix curve of the dazzle cone is a rectangle, the dazzle cone being defined by at least:

- a first directional axis passing through the vertex of said cone and through a first geographical point on the perimeter of the window and being defined by a first azimuth and a first elevation;
- a second directional axis passing through the vertex of said cone and through a second geographical point on the perimeter of the window and being defined by a second azimuth and a second elevation.

Advantageously, the directrix curve of the dazzle cone is a rectangle, the dazzle cone being defined by:

- a first directional axis passing through the vertex of said cone and through a first vertex of the rectangle;
- a second directional axis passing through the vertex of said cone and through a second vertex of the rectangle;
- the first and second vertices of the rectangle being non-consecutive.

The assembly for individualized control according to the invention comprises:

- a dazzle sensor for supplying a value representative of dazzle inside the room;
- a control unit comprising;
- a controller connected to means of closing off at least one window and able to deliver control orders to said means;

storage means storing programs able to control the transmission of the control orders according to the values representative of dazzle which are supplied by the dazzle sensor.

For preference, the dazzle sensor supplies a value representative of the dazzle at a dazzle-sensitive zone situated inside the building.

According to one embodiment of the invention, the control unit comprises means of determining an orientation of the direct rays of sunlight, said orientation being defined by a solar azimuth and a solar elevation. The dazzle sensor comprises means for determining coordinates of at least one dazzle cone associated with a window and with a dazzle-sensitive zone situated inside the building, said dazzle cone being defined by, on the one hand, a vertex positioned at the sensitive zone and a directrix curve superimposed on the perimeter of said at least one window. The controller of the control unit delivering control orders to the closing-off means associated with said at least one window for which the orientation of the rays of sunlight falls within at least one dazzle cone.

For preference, the control assembly comprises means for measuring the light intensity outside and/or the light intensity inside in an environment close to said at least one window that is to be closed off; the programs stored in the memory of the control unit being able to control the transmission of control orders according to values representative of the dazzle which are supplied by the dazzle sensor in relation to the values representative of the light intensity outside and/or of the light intensity inside and of the temperature.

For preference, the control assembly comprises means for measuring the temperature outside and/or the temperature inside in an environment close to said at least one window that is to be closed off; the programs stored in the memory of the control unit being able to control the transmission of control orders according to values representative of the dazzle which are supplied by the dazzle sensor in relation to the values representative of the temperature outside and/or of the temperature inside and of the temperature.

Advantageously, the storage means store the orientation of the direct rays of sunlight and coordinates of at least one dazzle cone.

Advantageously, the control assembly comprises communication means of the wired or radio type, able to communicate with external parameter-setting tools.

The parameter-setting tool according to the invention comprises sighting means allowing alignment between a dazzle-sensitive zone situated inside a building and at least two points positioned on the perimeter of at least one window. Processing means are able to determine, for each alignment, a directional axis defined by an azimuth and an elevation.

According to one embodiment, the processing means determine, according to the directional axes, the coordinates of at least one dazzle cone associated with a window and with a dazzle-sensitive zone situated inside the building.

For preference, said tool comprises communication means of the wired or radio type able to communicate with a control assembly as defined hereinabove in order to transmit the coordinates of at least one dazzle cone to said assembly.

BRIEF DESCRIPTION OF THE FIGURES

Other advantages and features will become more clearly apparent from the description which will follow of one particular embodiment of the invention given by way of nonlimiting example and depicted in the appended drawings in which.

DETAILED DESCRIPTION OF ONE EMBODIMENT

The invention relates to a method for the individualized and automated control of the means for closing off at least one window 1, 2 situated on a façade of a building.

Figure 1:
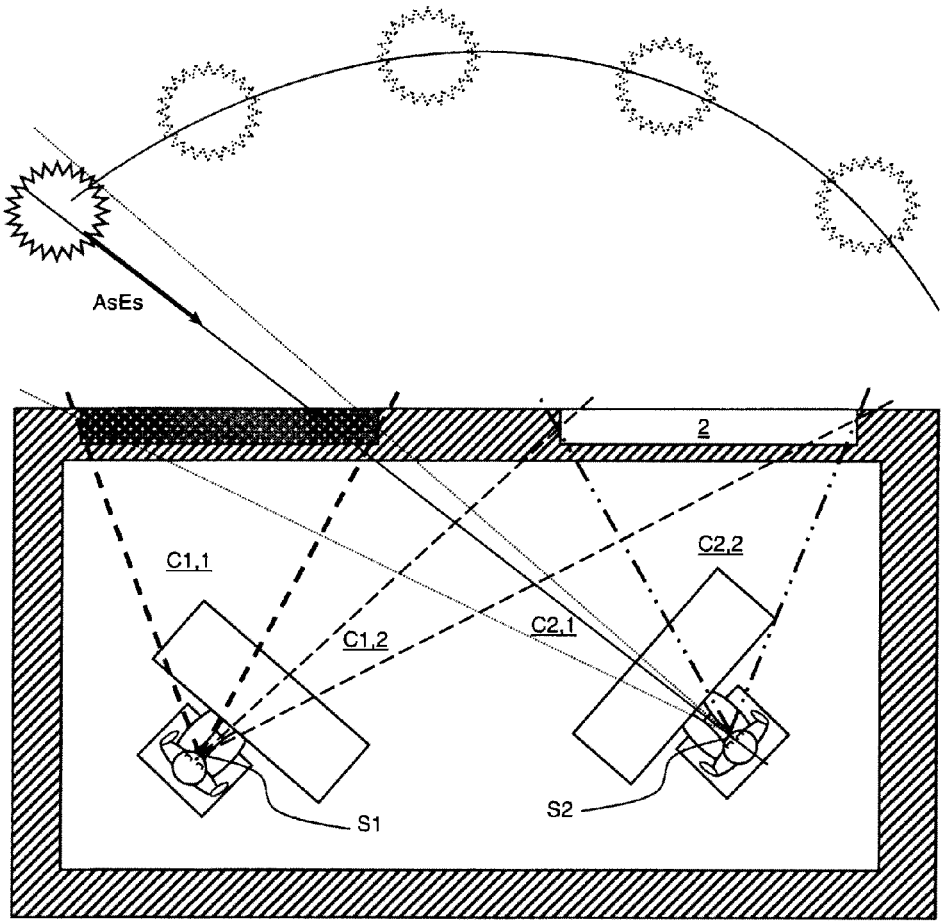
FIGS. 1 to 3 depict various scenarios whereby an interior space of a building is illuminated by sunlight.

As depicted in FIG. 1, by way of an example of application, the control method is suited to the management of means for closing off at least two windows 1, 2 which are arranged on one and the same façade of the building and give access to an inside space.

Figure 2:
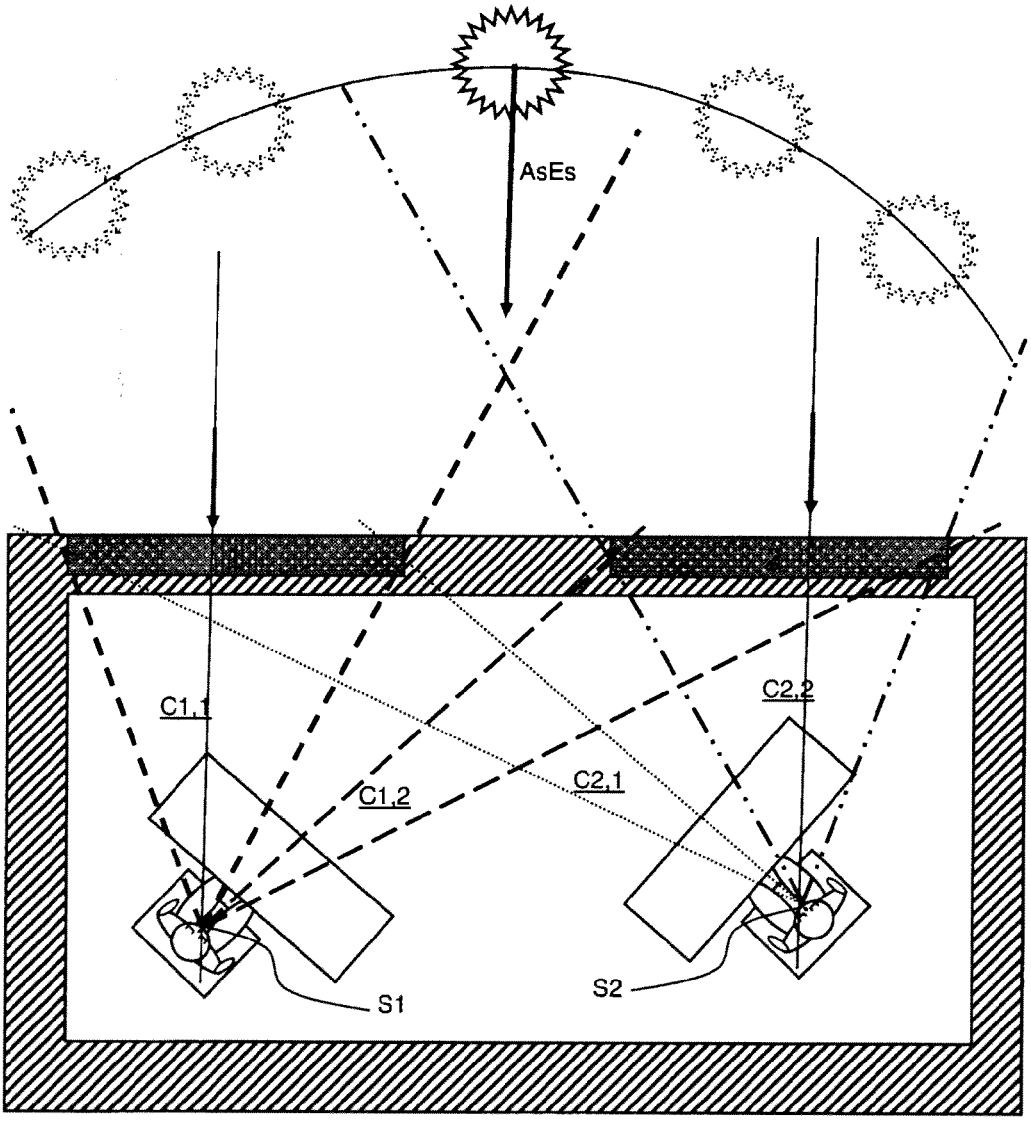
Figure 3:
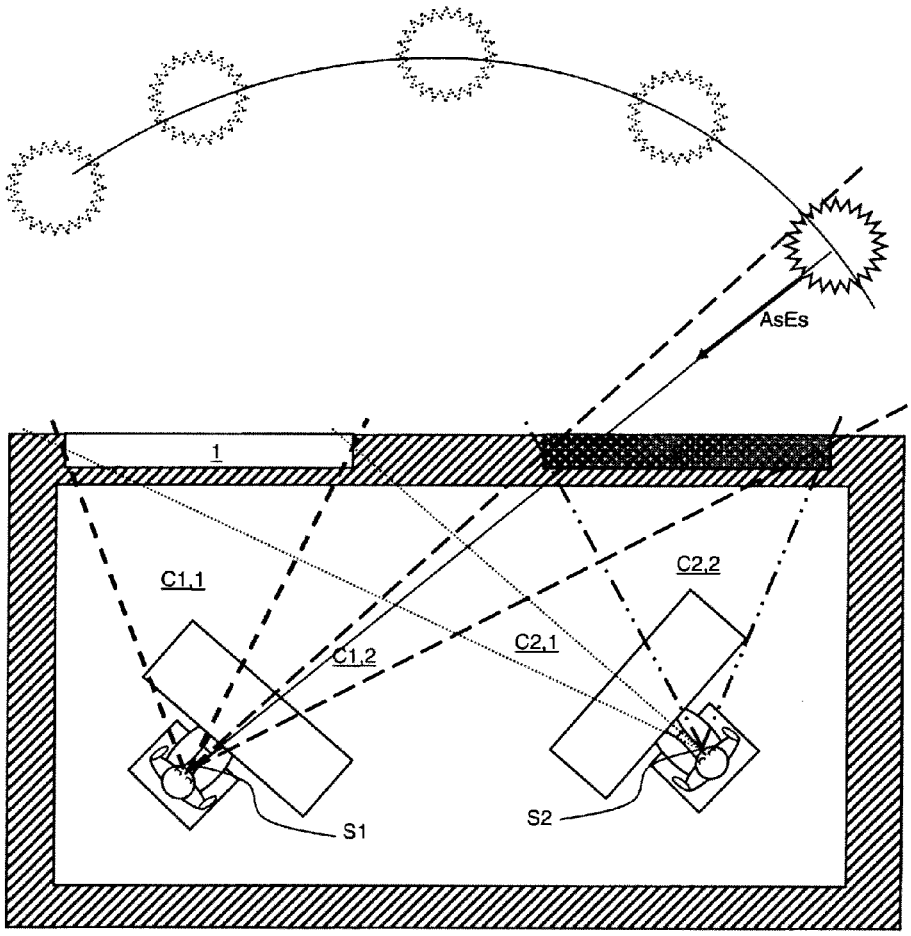

Within each inside space associated with at least one window there is defined at least one dazzle-sensitive zone S1, S2. A dazzle-sensitive zone is in theory characterized by a point. In practice, as depicted in FIGS. 1 to 3, the dazzle-sensitive zones S1, S2 are located substantially at eye level of the people situated within the inside space.

As depicted in FIG. 1 by way of an example of application, there are two dazzle-sensitive zones S1, S2. In this example, two people have therefore been depicted, sitting at their desk, and the dazzle-sensitive zones S1, S2 are respectively at eye-level of each of said people. In this example, each individual may thus be dazzled by the rays of sunlight coming in through one and/or the other of the two windows 1, 2.

In a first step, the method according to the invention consists in determining coordinates of at least one dazzle cone C1/1, C1/2 C2/1, C2/2 associated with a window 1, 2 and with a dazzle-sensitive zone S1, S2 situated inside the building.

Figure 4:
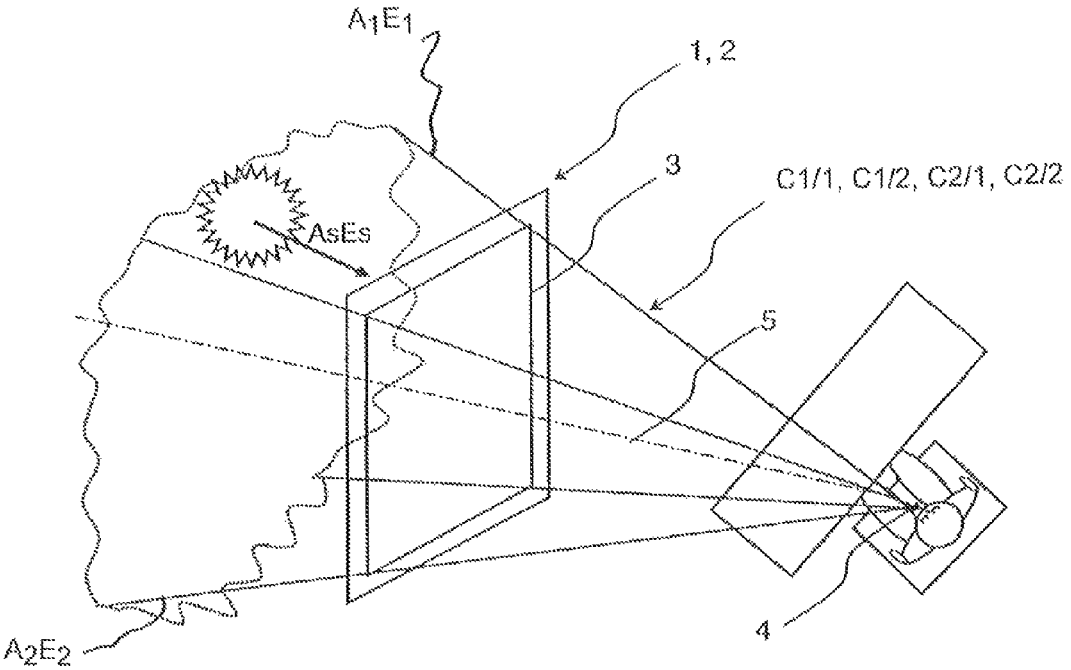
FIG. 4 depicts a scene for the setting of the parameters of a dazzle cone using a parameter-setting tool according to one embodiment of the invention.

As depicted in FIG. 4, said dazzle cone C1/1, C1/2, C2/1, C2/2 is defined on the one hand by a vertex 4 positioned at the sensitive zone and, on the other hand, by a directrix curve 3 superimposed on the perimeter of said at least one window 1, 2. A generatrix 5 of the cone therefore passes through the vertex 4 of the dazzle cone and the centre of a surface delimited by the generatrix curve 3. In this embodiment, the directrix curve 3 of the dazzle cone is a rectangle.

Said dazzle cone is therefore defined by at least one first and one second directional axis A1E1, A2E2.

Said at least one first directional axis A1E1 passes through the vertex 4 of said cone and through a first geographical point on the perimeter of the window. The first directional axis A1E1 is therefore defined by a first azimuth A1 and a first elevation E1. By way of an example of application, the first directional axis A1E1 preferably passes through the vertex of said cone and through a first vertex of the rectangle.

Said at least one second directional axis A2E2 passes through the vertex 4 of said cone and through a second geographical point on the perimeter of the window. The second directional axis A2E2 is therefore defined by a second azimuth A2 and a second elevation E2. By way of an example of application, the second directional axis A2E2 passes through the vertex of said cone and through a second vertex of the rectangle. The first and second vertices of the rectangle are non-consecutive.

In a second step, the method according to the invention consists in determining the orientation of the direct rays of sunlight. The orientation of said rays is defined by a solar azimuth As and a solar elevation Es. As depicted in FIG. 4, the orientation of the direct rays of sunlight is indicated by a vector AsEs.

By way of example, a directional light sensor is positioned on the façade of the building. For preference, the directional sensor is positioned as close as possible to the windows 1, 2 that have the closing-off means.

The azimuth and elevation coordinates are logged periodically in storage means 102. The logging period is a period for which parameters can be set. By way of example, the azimuth and elevation coordinates may be evaluated every minute and logged every quarter of an hour. A dazzle assessment may be initiated following each logging.

In a third step, the method consists in periodically checking whether the orientation of the rays of sunlight falls within at least one predetermined dazzle cone.

The orientation of the rays of sunlight which is indicated by a vector AsEs falls within a dazzle cone C1/1, C1/2, C2/1, C2/2 when said vector AsEs is parallel with one of the directions contained within the dazzle cone and passing through the vertex of the cone.

The method consists in acting on the closing-off means associated with said at least one window for which the orientation of the rays of sunlight falls within at least one dazzle cone. The action consists in closing said closing-off means.

In a preferred embodiment, the control method consists in the voltage control of the closing-off means comprising a glass of electrochromic type positioned in the window recess of the window that is to be closed off. A glass of the electrochromic type is a glass that contains an electrochemically active device that reacts chemically to the application of a supply of electricity. The optical transmittance of a glass of electrochromic type is thus electrically controlled.

The closing-off means act gradually on the glass of electrochromic type so as to darken said glass between a minimum threshold that allows a maximum amount of light through and a maximum threshold that allows a minimum amount of light through.

According to one particular embodiment of the invention, the control method consists in determining the light intensity outside in an environment close to said at least one window that is to be closed off. The measured light intensity is compared against a closing-off threshold Soc. The parameters of the closing-off threshold Soc can be set and this threshold is already logged in the storage means. The closing-off threshold Soc corresponds to a light threshold beyond which there is no longer any need to close off the inside space. Thus, if the light intensity outside is below the closing-off threshold, the method consists in acting on the closing-off means in order to reduce the level of closing off.

According to one embodiment of the invention, the control method consists in both determining the light intensity outside in an environment close to said at least one window that is to be closed off and determining the light intensity inside the inside space. The action on the closing-off means is then dependent on three parameters: the light intensity outside, the light intensity inside and the orientation of the rays of sunlight. According to this embodiment, the control method makes it possible to act on the closing-off means in such a way that the light intensity in the inside space is constant.

According to a variant, the control method consists in acting on the means of closing off at least one window adjacent to said at least one window for which the orientation of the rays of sunlight falls within at least one dazzle cone.

The control method according to the invention consists in converting all of the coordinates into one and the same spatial frame of reference so that the coordinates of the directions of the dazzle cone, of the solar azimuth As and solar elevation Es can be expressed in an absolute or relative frame of reference. By way of example, the coordinates are converted into an absolute frame of reference in which, for example, north corresponds to 0 degrees of azimuth and the horizontal corresponds to zero degrees of elevation. In a second embodiment, the coordinates are converted into a frame of reference relating to one of the windows, in which the direction perpendicular to the window corresponds to 0° of azimuth and to 0° of elevation.

By way of an example of an application of the method for individualized control according to the invention, FIGS. 1 to 3 respectively depict a scene in which an inside space of a building which is illuminated by the sun at three different times in the day is schematically depicted. The inside space comprises two workstations each having a respective dazzle-sensitive zone S1, S2 positioned at eye level of a person present at the workstation. The rays of sunlight enter the inside space through two windows 1, 2. In this configuration, the control method is able to define two dazzle cones per dazzle-sensitive zone:

- a first cone C1/1 associated with the first window and with a first dazzle-sensitive zone S1;
- a second cone C2/1 associated with the second window and with the first dazzle-sensitive zone S1;
- a third cone C1/2 associated with the first window and with the second dazzle-sensitive zone S2;
- a fourth cone C2/2 associated with the second window and with a second dazzle-sensitive zone S2.

During the course of a sunny day, according to the movement of the sun across the façade of a building, the method for individualized and automated control will successively act on the closing-off means of the window 1 and/or of the window 2.

As depicted in FIG. 1, the orientation of the direct rays of sunlight, which is indicated by the vector AsEs, is parallel to a direction comprised within the third dazzle cone C2/1 and passing through the vertex of said cone. In other words, the orientation of the rays of sunlight falls only within the third dazzle cone C2/1. Thus, bearing in mind the fact that the second sensitive zone S2 is subjected to dazzle, the control assembly 100 acts on the closing-off means associated with the first window 1 in order to reduce or eliminate the ingress of external light radiation.

As depicted in FIG. 2, the orientation of the direct rays of sunlight, which is indicated by the vectors AsEs, is parallel both

- to a direction comprised within the first cone C1/1 and passing through the vertex of said cone, and
- to a direction comprised within the fourth dazzle cone C2/2 and passing through the vertex of said cone. In other words, the orientation of the rays of sunlight falls both inside the first and inside the fourth dazzle cones.

Thus, bearing in mind the fact that the first and second sensitive zones S1, S2 are subjected to dazzle, the control assembly 100 acts on the closing-off means associated with the two windows 1, 2 in order to reduce or eliminate the ingress of external light radiation.

As depicted in FIG. 3, the orientation of the direct rays of sunlight, which is indicated by the vector AsEs is parallel to one of the directions comprised within the second dazzle cone C1/2 and passing through the vertex of said cone. In other words, the orientation of the rays of sunlight falls within the second dazzle cone. Thus, bearing in mind the fact that the second sensitive zone S2 is subjected to dazzle, the control assembly 100 acts on the closing-off means associated with the second window 2 in order to reduce or eliminate the ingress of external light radiation.

The invention also relates to an assembly 100 for the individualized and automated control of the closing-off means of at least one window 1, 2 of a building for implementing the method as defined hereinabove.

Said assembly for individualized and automated control comprises an outside and/or inside dazzle sensor to supply a value indicative of dazzle inside the room. Said assembly further comprises a control unit comprising a controller 101 connected to the means of closing off at least one window 1, 2 and able to deliver control orders to said means. The control unit comprises storage means storing programs able to control the transmission of control orders according to values representative of dazzle which are supplied by the dazzle sensor.

For preference, the dazzle sensor supplies a value representative of the dazzle at a dazzle-sensitive zone situated inside the building.

Figure 5:
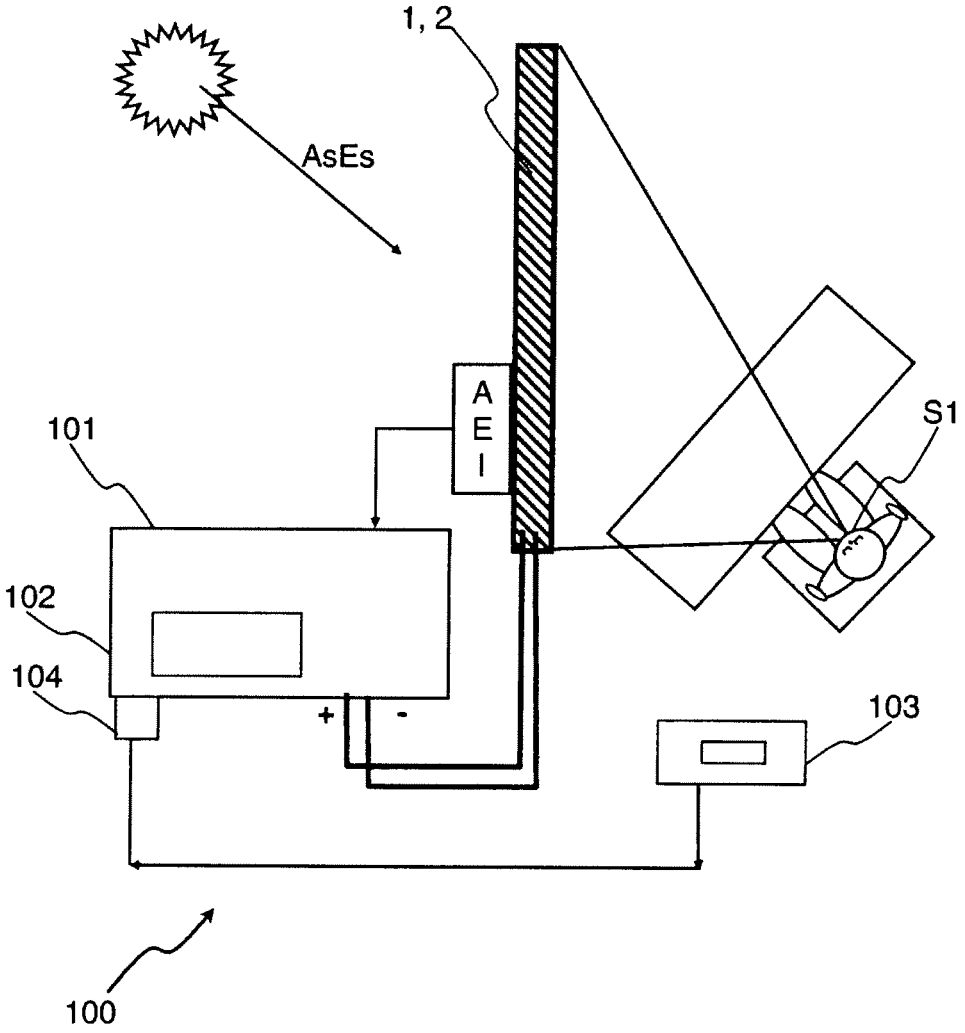
FIG. 5 depicts a control assembly for implementing said method according to one embodiment of the invention.

According to a preferred embodiment, the control unit of the control assembly comprises means AEI for determining an orientation of the direct rays of sunlight, said orientation being defined by a solar azimuth As and a solar elevation Es. As depicted in FIGS. 4 and 5, the orientation of the direct rays of sunlight is represented by the vector AsEs.

Furthermore, the dazzle sensor comprises means 103 for determining the coordinates of at least one dazzle cone C1/1 associated with a window 1, 2 and with a dazzle-sensitive zone S1 situated inside the building, said dazzle cone being defined by, on the one hand, a vertex positioned at the sensitive zone and a directrix curve superimposed on the perimeter of said at least one window 1, 2. According to this embodiment of the invention, the controller of the control unit delivering the control orders to the closing-off means associated with said at least one window 1, 2 for which the orientation of the rays of sunlight falls within at least one dazzle cone.

According to a first alternative form, the control assembly comprises means of measuring the light intensity outside and/or the light intensity inside in an environment close to said at least one window that is to be closed off. The measurement of the light intensity on the inside, combined with other parameters notably allows control over the turning-on of the light inside the room. The measurement of the light intensity may be taken continuously or periodically. The programs stored in the memory of the control unit are then able to control the transmission of control orders according to values representative of dazzle which are supplied by the dazzle sensor with respect to the values representative of the light intensity outside and/or of the light intensity inside.

In a second alternative form, the control assembly comprises means of measuring the temperature to supply a value representative of a temperature on the outside and/or of the temperature inside in an environment close to said at least one window that is to be closed off. The measurement of the temperature on the inside, combined with other parameters notably allows control over the turning-on of the light inside the room. The measurement of temperature may be taken continuously or periodically. The programs stored in the memory of the control unit are then able to control the transmission of control orders according to values representative of dazzle which are supplied by the dazzle sensor with respect to the values representative of the outside temperature and/or of the inside temperature.

According to another alternative form, the programs stored in the memory of the control unit are then able to control the transmission of control orders according to values representative of dazzle which are supplied by the dazzle sensor with respect to the values representative of the temperature outside and/or inside and of the light intensity outside and/or inside.

In this other alternative form, a presence detector will allow the control unit to determine whether or not there is anybody in the room. If the room is occupied, the programs stored in the memory of the control unit control the transmission of the control orders according to the values representative of dazzle which are supplied by the dazzle sensor with respect to the values representative of light intensity outside and/or light intensity inside. In this scenario, the visual comfort of the occupant is given precedence, preventing this occupant from being dazzled by using the dazzle cone method and providing him with a minimum level of brightness by switching on the lights if the brightness inside is too low.

If the room is unoccupied, the programs stored in the memory of the control unit control the transmission of control orders according to values representative of dazzle which are supplied by the dazzle sensor with respect to the values representative of temperature outside and/or temperature inside. In this scenario, energy savings take precedence, by darkening the windows that can be closed off when the room needs to be cool (when the temperature inside is higher than the setpoint temperature and the brightness outside is strong) and by making the windows that can be closed off paler when the room needs to be heated (when the temperature inside is below the setpoint temperature). In this scenario, the setpoint temperature is dependent on the temperature outside.

Furthermore, said control assembly 100 comprises storage means 102 for storing sets of data notably regarding the orientation of the direct rays of sunlight and the coordinates of at least one dazzle cone and the light intensities outside and inside.

According to one embodiment of the invention, the control assembly comprises communication means 104 of the wired or radio type able to communicate with external parameter-setting tools 103.

The invention also relates to a tool 103 for setting the parameters of at least one dazzle cone C1/1, C1/2, C2/1, C2/2 able to communicate with a control assembly 100 defined hereinabove. The tool 103 comprises sighting means allowing alignment between a dazzle-sensitive zone and a point positioned on the perimeter of at least one window, the perimeter defining the directrix curve of the dazzle cone. The parameter-setting tool comprises processing means able to determine, for each alignment, a direction axis A1E1 defined by an azimuth A1 and an elevation E1.

By way of an example of application, the first directional axis A1E1 preferably passes through the vertex of said cone and through a first vertex of the rectangle.

The set of measured and logged coordinates is transmitted to the assembly for individualized control. By way of example, the sighting means comprise a light beam of the laser type. By aiming the tool from the sensitive zone S1, S2 towards a geographical position, notably a point positioned on the perimeter of the window, the tool determines an azimuth A1 using an in-built electronic compass and an elevation E1 using an electronic gyroscope. An azimuth data point associated with an elevation data point allows a directional axis to be defined. The processing means determine, according to the directional axes, the coordinates of at least one dazzle cone associated with a window 1, 2 and with a dazzle-sensitive zone situated inside the building. The parameter-setting tool comprises communication means of the wired or radio type able to communicate with a control assembly for transmitting the coordinates of at least one dazzle cone to said assembly.

The invention claimed is:

1. A method for individualized and automated control of means for closing off at least one window of a building, the method comprising, acting on closing-off means associated with at least one window according to the orientation of direct rays of sunlight as defined by a solar azimuth and a solar elevation by:

determining coordinates of at least one dazzle cone associated with a window, and with a dazzle-sensitive zone situated inside the building in which said window resides, said at least one dazzle cone being defined by a vertex point positioned in the dazzle-sensitive zone, said vertex point being selected by a user of said method, and a directrix corresponding to the perimeter of said window by identifying a plurality of directional axes each passing through the vertex point of said dazzle cone and through one of a plurality of reference points on the perimeter of the window, each of which points (n) is defined by the azimuth (An) and elevation (En) of the directional axis passing through said point;

storing the azimuth and elevation of each of said plurality of directional axes which define the dazzle cone;

periodically checking whether the direction of direct rays of sunlight entering said window falls within at least one predetermined dazzle cone, and passes through the vertex of said cone by comparing the direction of said rays of sunlight to the directions of said directional axes which define the dazzle cone; and if the result of said periodic checking shows that the direction of said rays of sunlight corresponds to a directional axis within the defined dazzle cone, acting on the closing-off means associated with said window.

2. The control method as claimed in claim 1, additionally comprising:

determining the light intensity outside said building in an environment close to said window that is to be closed off, comparing the determined light intensity against a closing-off threshold (Soc), and acting on the closing-off means when the closing-off threshold is crossed.

3. The control method as claimed in claim 1, wherein the building includes a second window which is adjacent said at least one window, said second window also having second closing-off means, the method additionally comprising acting on the closing-off means of the second window, if the direction of the rays of sunlight entering said second window corresponds to a directional axis within a dazzle cone defined with regard to said second window.

4. The control method as claimed in claim 1, wherein the closing-off means comprises electrochromic type window glass.

5. The control method as claimed in claim 4, wherein the closing-off means act on the glass of electrochromic type to gradually darken said glass between a minimum threshold that allows a maximum amount of light to pass therethrough and a maximum threshold that allows a minimum amount of light to pass therethrough.

6. The control method as claimed in claim 5, additionally comprising measuring light intensities outside and inside the building, and acting on the closing-off means so that the light intensity on the inside is constant.

7. The control method as claimed in claim 1, wherein all of the coordinates are expressed in the same spatial frame of reference so that the coordinates of the directions of the cone, of the solar azimuth, and of the solar elevation, are in an absolute or relative frame of reference.

8. The control method as claimed in claim 1, wherein the directrix of the dazzle cone is a rectangle, and the dazzle cone is defined by at least:

a first directional axis passing through the vertex of said cone and through a first reference point on the perimeter of the window, which first point is defined by a first azimuth (A1) and a first elevation (E1); and a second directional axis passing through the vertex of said cone and through a second reference point on the perimeter of the window, which second point is defined by a second azimuth (A2) and a second elevation (E2).

9. The control method as claimed in claim 8, wherein:

the first directional axis passes through a first corner of the rectangle; and the second directional axis passes through an opposite corner of the rectangle.

* * * * *